United States Patent [19]

Scroggins

[11] 4,026,137

[45] May 31, 1977

[54] TWISTING AND BENDING MACHINE FOR ELONGATED METALLIC STRIPS

[76] Inventor: Henry L. Scroggins, 11721 Gilbert St., Garden Grove, Calif. 92646

[22] Filed: Apr. 19, 1976

[21] Appl. No.: 678,195

[52] U.S. Cl. ..... 72/299

[51] Int. Cl.[2] ..... B21D 11/14

[58] Field of Search ..... 72/299, 310, 371, 64, 72/151; 140/149

[56] References Cited

UNITED STATES PATENTS

| | | | |
|---|---|---|---|
| 392,119 | 10/1888 | Hardsocg | 72/299 |
| 825,511 | 7/1906 | Blondell | 72/299 |
| 2,192,783 | 3/1940 | Ackerman | 72/64 |
| 2,636,538 | 4/1953 | Algatt | 72/299 |
| 2,835,283 | 5/1958 | Thone et al. | 140/149 |
| 2,929,434 | 3/1960 | Barnes | 72/299 |
| 3,015,355 | 1/1962 | Humphrey | 72/299 |

*Primary Examiner*—Michael J. Keenan
*Attorney, Agent, or Firm*—Jack C. Munro

[57] ABSTRACT

A machine for twisting and bending of elongated metallic strips which takes the form of a base upon which is mounted an elongated member of polygonal cross-section. A first holder is fixed to one end of said elongated member with a second holder being slidably mounted upon said elongated member adjacent the free end thereof. Within the first holder is located a first grasping means. Within the second holder is located a second grasping means. An elongated metallic strip is to be fixedly secured at each end thereof to said first grasping means and said second grasping means and to be positioned in a taut manner therebetween. A biasing means is included within said second holder with said second grasping means moving against said biasing means. A torque applying means attached to said first grasping means. Upon rotational movement of said torque applying means a uniform twist is established along the length of the metallic strip. A twist eliminator structure may be connected to the machine which would prevent a twist being formed a selected distance spaced from each end of the metallic strip if such is desired.

8 Claims, 8 Drawing Figures

TWISTING AND BENDING MACHINE FOR ELONGATED METALLIC STRIPS

BACKGROUND OF THE INVENTION

The field of this invention relates broadly to metal fabricating. More particularly, this invention relates to the formation of thin, flat metallic strips into a twisted or generally curvilinear configuration.

The bending or twisting of a thin, elongated metallic strip into a helical shape in the past has been difficult to accomplish satisfactorily. One reason for this is that as the strip is twisted into the helical shape the strip automatically shortens in length. Normally, the strip is bound between two fixed members and as the strip is shortened in shape, the metal inherently must stretch. It does not take much twisting for the stretch achieved causes failure of the strip.

Another reason is that in the past it has been difficult to establish an even pitch of the twist. This is due to in any quality of strength throughout the strip especially due to the stretching of the strip. This results in certain portions of the strip to twist into a closer spiral than the other portions.

SUMMARY OF THE INVENTION

The structure of this invention is believed to be summarily described in the Abstract Of The Disclosure and reference is to be had thereto.

One object of the present invention relates to the forming of elongated metallic strips in a generally helical shape without the need for a complex or expensive equipment.

A further object of this invention relates to the including within the machine of this invention additional structure to permit the forming of the metallic strip into a smoothly contoured spiral.

A still further object of this invention relates to a machine which inherently always produces a smooth, even spiral wherein the length of each section of the spiral is identical with each other section of the spiral.

A still further object of this invention relates to the including of means to eliminate the forming of twists adjacent the ends of the metallic rod so that the twisted length of the metallic rod may be preselected.

A further object of this invention is to provide means included within the machine of this invention to apply a substantially continuous force along the longitudinal length of the metallic strip to be twisted during the entire twisting movement which results in even lengths being produced for each of the spiral sections.

DETAILED DESCRIPTION OF THE SHOWN EMBODIMENT

Figure 1:
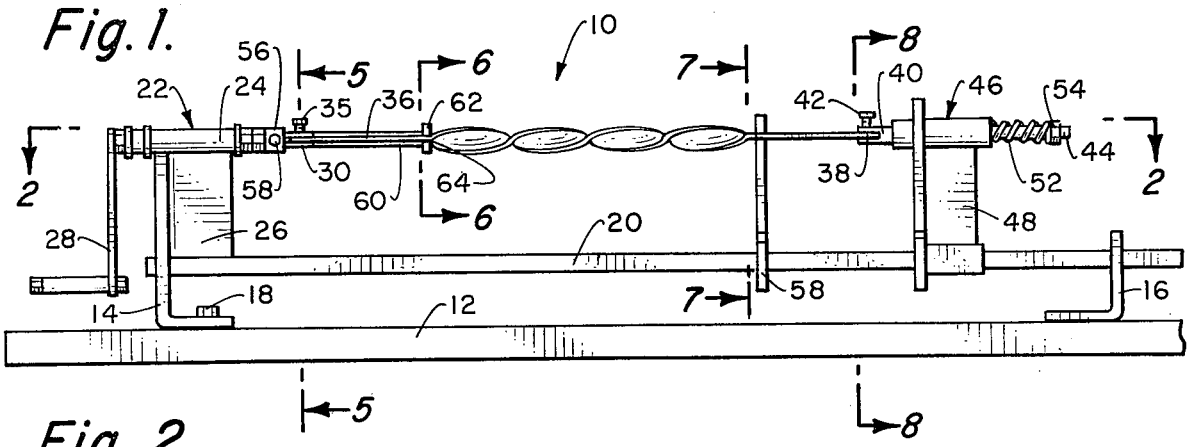
FIG. 1 is an elevational side view of the machine of this invention.

Referring particularly to the drawing, there is shown the machine 10 of this invention which has been fixedly secured to a planar supporting surface, such as a table 12. The machine 10 includes a base which takes the form of a first bracket 14 and a second bracket 16. The bracket 14 is secured to the table 12 by means of bolts 18. In normal practice, it will not be necessary to secure the bracket 16 to the table 12 as the bracket 16 only functions as a resting support.

Fixedly connected between the brackets 14 and 16 is an elongated member 20. In cross-section, the member 20 is shown to be a square, but it is considered to be within the scope of this invention that any configuration could be employed, either polygonal or round. However, a polygonal configuration is preferred for reasons which will become apparent further on in the specification.

Fixedly secured to one end of the rod 20 is a first holder 22. The first holder 22 is also secured to bracket 14.

The first holder 22 includes an outer sleeve 24. This outer sleeve 24 is attached to supporting bracket 26 which is fixedly secured to elongated member 20. The sleeve 24 is also fixed to the bracket 14.

Within the sleeve 24 is rotatably mounted a rod 26. The outer end of the rod 26 is attached to a torque applying means which takes the form of a handle member 28. The inner end of the rod 26 is fixedly secured to a first grasping means which takes the form of a member 30 which has at its outer end thereof a slot 32. Extending through the member 30 and connecting with the slot 32 is a fastener 34. One end of an elongated flat metallic strip 36 is to connect with the slot 32 and the fastener 34 tightened thereby fixing the member 36 to the member 30.

The free end of the metallic strip 36 is located within a slot 38 formed within a member 40. A fastener 42 extends through a portion of the member 40 and connects with the slot 38. The fastener 42 is to be tightened to secure the metallic member 36 to the member 40.

The member 40 is fixedly secured to a rod 44. The rod 44 is slidably mounted within a second holder 46 which takes the form of a member 48. The member 48 includes an annular chamber 50 which surrounds a portion of the rod 44. Within the annular chamber 50 is located a coil spring 52. The free end of the coil spring 52 abuts a nut 54 which is threadably attached to the outer end of the rod 44.

The member 48 also includes an opening 56. This opening 56 matingly cooperates with the polygonal shaped member 20 and is capable of slidable movement in respect thereto.

Also slidably mounted upon the member 20 is an eliminator member 58. A polygonal shaped opening 60 is formed within the member 58 and is adapted to matingly cooperate therewith in a close fitting but in a sliding fit manner. Because the rod 20 is polygonal shaped, the member 58 as well as the member 48 are not capable of rotational movement with respect to the member 20.

The outer end of the member 58 includes a slot 62. Within the slot 62 is to be located a strip 36. The member 58 movable upon the rod 20 and is located adjacent the second holder 46. In some instances, it may be desirable to not twist a portion of the member 36, as for instance, the first few inches of the member from the end that is connected to the second holder 46. In order to accomplish this, the member 58 is placed on the strip 36 where desired and then during operation of the device of this invention there will be no twist formed on the member 36 between the member 58 and the second holder 46.

A similar twist eliminator is attached to the member 34 which includes a sleeve 56 which is located about the member 30. A fastener 58 extends through the sleeve 56 and is adapted to be tightened against the member 30 thereby fixing the sleeve 56 thereto. Extending from the sleeve 56 longitudinally along the length and adjacent thereto, the strip 36 is an extension 60. Slidably mounted on the extension 60 is a member 62. The member 62 includes a slot 64. Within the slot 64 is located the strip 36.

By sliding of the member 62 any distance from the member 30 to the entire length of the extension 60, the twist will be eliminated in that area from where the member 62 is located to the end of the strip 36 that is connected to the member 30.

Figure 2:
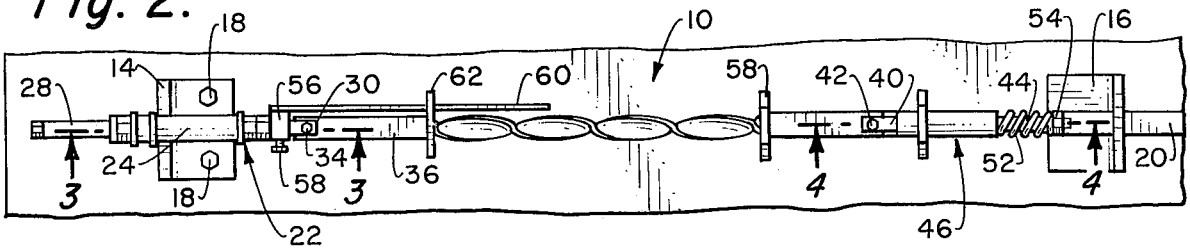
FIG. 2 is a plan view of the machine of this invention taken along line 2—2 of FIG. 1.
Figure 3:
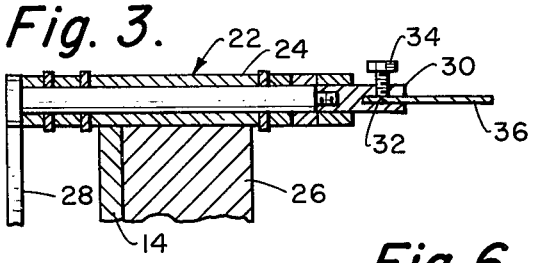
FIG. 3 is a cross-sectional view taken along line 3—3 of FIG. 2.
Figure 4:
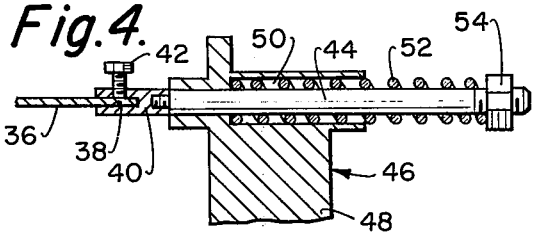
FIG. 4 is a cross-sectional view taken along line 4—4 of FIG. 2.
Figure 5:
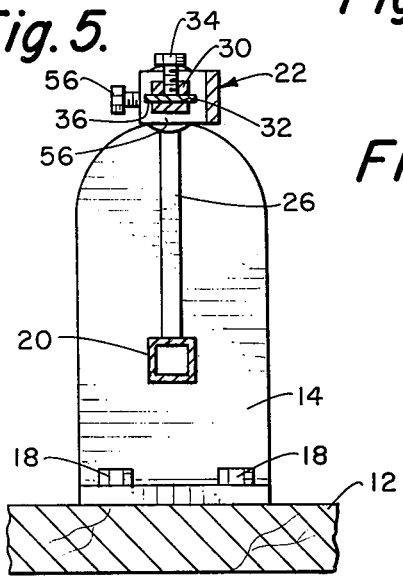
FIG. 5 is a cross-sectional view taken along line 5—5 of FIG. 1.
Figure 6:
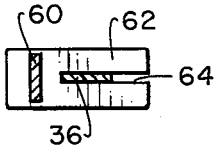
FIG. 6 is a cross-sectional view taken along line 6—6 of FIG. 1.
Figure 7:
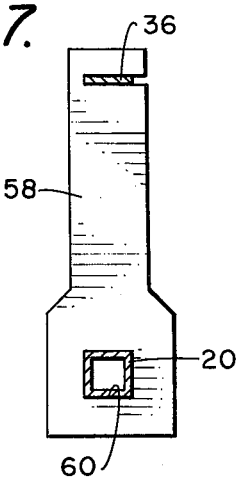
FIG. 7 is a cross-sectional view taken along line 7—7 of FIG. 1.
Figure 8:
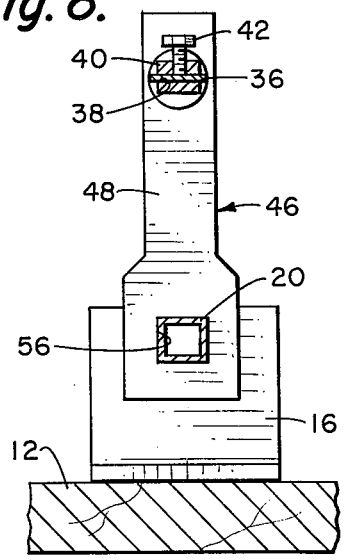
FIG. 8 is a cross-sectional view taken along line 8—8 of FIG. 1.

In operation, the operator merely places the metallic strip 36 in its undeformed state, one end of which is secured to the member 30 and the other end of which is secured to the member 40. The operator then strikes the member 48 adjacent the rod 20 in an outward direction. This causes the strip 36 to become taut and actually cants the member 48 so that it slightly bites into the elongated member 20 thereby securing the member 48 with respect to the rod 20. The placement of the eliminators 58 and 62 is then instituted, if such are desired. The operator then proceeds to turn the handle 28 which causes one end of the strip 36 to be turned with respect to the other end. This results in the producing of then spiral condition along the length of the strip 36, such as depicted in FIGS. 1 and 2.

As the spiral condition is produced in the strip 36, the strip 36 is shortened. This shortening of the strip 36 is compensated for by the rod 44 extending against the bias of the coil spring 52. Because of the use of the coil spring 52 a continuous force is applied against the strip 36 which insures that each of the spiral sections produced along the strip 36 is of the same length as every other section in the strip.

What is claimed is:

1. A machine comprising:

a base, said base including an elongated member upon which is mounted a first holder and a second holder, said second holder being movable upon said elongated member toward and away from said first holder and fixable by fixing means in a particular selected position;

first grasping means connected to said first holder, said first grasping means being rotatable in respect to said first holder, said first grasping means adapted to securely connect with an elongated metallic strip;

torque applying means connected to said first grasping means, said torque applying means to effect rotation of said first grasping means;

said second holder including a second grasping means, said second grasping means includes a member secured against rotation in respect to said second holder but capable of a limited amount of longitudinal movement in respect thereto between a retracted position and an extended position, said member securable to the free end of said elongated metallic strip resulting in said elongated metallic strip being held in a taut manner between said first grasping means and said second grasping means; and biasing means connected to said second grasping means, said biasing means tending to maintain said member in said retracted position, said biasing means comprises a coil spring assembly, one end of said coil spring assembly connected to the free end of said member with the other end of said spring assembly abutting said second holder, the direction of the force of the spring assembly coincides with the longitudinal center axis of said elongated metallic strip.

2. The machine as defined in claim 1 wherein:

said elongated member being polygonal in cross-section, said second holder having an aperture therein adapted to mate with the cross-section of said elongated member, whereby said second holder not being capable of rotation with respect to said elongated member.

3. The machine as defined in claim 1 wherein:

said biasing means comprises a single coil spring wound about said member.

4. The machine as defined in claim 1 wherein said first grasping means comprises:

a rod, a fastener cooperating with said rod, said rod being rotatably mounted within appropriate aperture means within said first holder, said fastening means cooperating with a slot adapted to receive an end of said metallic strip, by tightening of said fastening means said metallic strip is securely bound within said slot.

5. The machine as defined in claim 4 wherein:

said biasing means comprises a single coil spring wound about said member.

6. The machine as defined in claim 1 including:

twist eliminator means attached to said machine and adapted to be movable along the length of said metallic strip, whereby upon rotation of said torque applying means said twist eliminator means preventing twisting of said metallic strip along a certain length of said metallic strip.

7. The machine as defined in claim 6 wherein:

said twist eliminator means includes a first eliminator slidably movable upon said elongated member and located adjacent said second holder, said eliminator being connectable through a slot with said metallic strip.

8. The machine as defined in claim 6 wherein:

said twist eliminator means includes a second eliminator in the form of an attaching member attached to said first grasping means and extending longitudinally along side a portion of said metallic member, a member slidably mounted upon said attaching member, said member including a slot adapted to receive said metallic strip and to be slidable thereon.

* * * * *